US006950024B2

(12) United States Patent
Wunderlick

(10) Patent No.: US 6,950,024 B2
(45) Date of Patent: Sep. 27, 2005

(54) SYSTEM FOR RECOVERING LOST JEWELRY AND DIAMONDS

(76) Inventor: John C. Wunderlick, 712 Stillwater Rd., Gibson Island, MD (US) 21056

( * ) Notice: Subject to any disclaimer, the term of this patent is extended or adjusted under 35 U.S.C. 154(b) by 367 days.

(21) Appl. No.: 10/041,280

(22) Filed: Jan. 8, 2002

(65) Prior Publication Data

US 2002/0091962 A1 Jul. 11, 2002

Related U.S. Application Data

(60) Provisional application No. 60/260,480, filed on Jan. 9, 2001.

(51) Int. Cl.[7] ..... G08B 23/00

(52) U.S. Cl. ..... 340/573.1; 340/568.1; 379/90.01

(58) Field of Search ..... 340/573.3, 573.1, 340/568.1; 707/104, 1, 3, 10; 379/90.01, 45; 714/1

(56) References Cited

U.S. PATENT DOCUMENTS 4,893,840 A * 1/1990 Berkowitz ..... 283/81
5,036,610 A * 8/1991 Fehr ..... 40/300
5,273,798 A * 12/1993 Miner ..... 428/41.5
5,353,351 A * 10/1994 Bartoli et al. ..... 380/33
5,983,238 A * 11/1999 Becker et al. ..... 707/104.1
6,114,426 A * 9/2000 Burack et al. ..... 524/409
6,259,367 B1 * 7/2001 Klein ..... 340/572.1

* cited by examiner

*Primary Examiner*—Anh V. La
(74) *Attorney, Agent, or Firm*—Law Offices of Royal W. Craig

(57) ABSTRACT

A system for facilitating the return of a lost piece of jewelry or diamond. A micro-label bearing a numeric code which identifies the owner of the jewelry and an alphanumeric telephone number (e.g., 1-866-RETURN ME), is affixed to the jewelry. Alternatively, the message may be discreetly micro-engraved or laser inscribed. A database compiled by the service provider cross-links the alpha-numeric code to the personal information of the owner. The message encourages the finder to call the telephone number to access the service provider and report the numeric code. The service provider determines the identity of the owner, and informs the owner that an item of jewelry bearing his or her code has been found. The service provider actively mediates the exchange by arranging a three party call to determine the most suitable method for returning the jewelry to the owner, and by suggesting a reward to encourage the finder to initiate the return process.

5 Claims, 5 Drawing Sheets

SYSTEM FOR RECOVERING LOST JEWELRY AND DIAMONDS

CROSS-REFERENCE TO RELATED APPLICATIONS

The present application derives priority from U.S. Provisional Patent Application 60/260,480 for "SYSTEM FOR RECOVERING LOST JEWELRY"; Filed: Jan. 9, 2001; Inventor: John C. Wunderlick.

BACKGROUND OF THE INVENTION

1. Field of the Invention

The present invention relates to the recovery of lost jewelry and diamonds, and more particularly, to a system for recovery that includes identification information affixed to jewelry by micro-labels or micro-engraving, and to diamonds by laser inscription, in order to prompt the finder to call a finder service provider.

2. Description of the Background

Determining the owner of lost or stolen jewelry and gems poses a hardship for a host of public authorities and private entities nationwide. From local police departments to the Federal Bureau of Investigation, establishing the identity of jewelry is an uncertain and often unsuccessful undertaking. Thousands of pieces of jewelry are auctioned each year after futile efforts to find the rightful owner. Lost and found departments at private businesses including hotels, stores, bars, restaurants, parks, and shopping malls are likewise confounded by the difficulty of returning lost items to their original owners. Further, insurance companies routinely pay on claims for lost jewelry items, and would profit from a method which would improve their insureds' chances for recovering lost jewelry.

Prior methods and articles to recover lost personal property have been attempted. U.S. Pat. No. 5,570,081 to Holstrom discloses a recovery system which uses a two-piece detachable card. One piece, the tag, is attached to the article to be protected, and the other piece, the base, is placed in a secure location. If the article is lost, instructions on the tag inform the finder to call a certain phone number and enter the tag number into a voice-mail recording. The owner may subsequently contact the message system and periodically check to see if any messages referencing his tag number have been posted.

U.S. Pat. No. 6,064,307 to Silver shows a method for recovering a lost object which also uses a tagging system. The tag informs the finder to call a phone number which accesses a clearing house. The finder is prompted to enter the code from the tag. The clearing house then forwards a call to the owner of the lost article, providing the telephone number from which the call was placed.

U.S. Pat. No. 5,180,192 to Herbert discloses an article and return method for lost personal accessories. An adhesive label instructing the finder to deposit the item found in a mailbox is attached to the item. Additionally, a second label carrying a barcode is applied to the item by the owner. The item is received by a central processing facility which uses the barcoded indicia to identify the owner, and the item is returned by mail to the owner.

U.S. Pat. No. 4,271,352 to Thomas teaches a method of processing lost items which maintains the secrecy of the lost items. A coded card is attached to an item of value. The finder is prompted to return the item carrying the coded card to a central processing center. The central processing center deciphers the code which includes the owners mailing address, packages the item, and ships the item to the owner.

However, none of the above or any known prior art references teach the use of a micro-label, micro-engraving or laser inscription small enough to be discreetly affixed to a piece of jewelry. Further, none of the prior art methods teach a system for recovering said jewelry and diamonds when lost that employs a clearing house with a live operator that receives the finder's call and mediates the return of the found article. In light of the foregoing, it would be of great advantage to create an improved system specifically designed to facilitate the recovery of lost jewelry and diamonds, wherein owner identification information affixed to jewelry by a micro-label or micro-engraving, or to diamonds by laser inscription, prompts a finder to call the service provider, who actively mediates the return of the lost jewelry.

SUMMARY OF THE INVENTION

It is therefore an object of the present invention to facilitate the return of an item of lost jewelry to its original owner.

It is another object of the present invention to affix a micro-label to an article of jewelry bearing the message "1-866-RETURN ME", or other like toll-free number, and an alpha-numeric code which is unique to each article of jewelry.

It is yet another object of the present invention to micro-engrave an article of jewelry with the message "1-866-RETURN ME", or other like toll-free number, and an alpha-numeric code which is unique to each article of jewelry.

It is another object of the present invention to laser inscribe on the girdle of a diamond the message "1-866-RETURN ME", or other like toll-free number, and an alpha-numeric code which is unique to each diamond or article of jewelry.

It is yet another object to prompt the finder of the lost article of jewelry to call the service provider at the toll free number printed on the micro-label.

A still further object of the invention is to enable the service provider to identify the owner by matching the alpha-numeric code to personal information compiled within a database maintained by the service provider.

It is another object of the invention to mediate the transfer of the lost article of jewelry from the finder to the owner.

According to the present invention, the above-described and other objects are accomplished by affixing a micro-label bearing the message "1-866-RETURN ME", or other like toll-free number, and an alpha-numeric code to a piece of jewelry. In the alternative, the identifying information may be micro-engraved on the jewelry. In the case of diamonds, the information may be laser inscribed on the girdle of the diamond. The micro-label, micro-engraving or inscription is small enough to be discreetly affixed to a piece of jewelry, yet conspicuous enough that a finder would see and understand the message. Upon calling the toll free number, the finder is directed by a live operator of the service provider to relate the alpha-numeric code, and the service provider identifies the owner. The service provider contacts the owner, verifies that the owner has indeed lost this particular article of jewelry, and mediates the method of return between finder and owner.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

This invention described herein is a system for facilitating the return of lost jewelry and diamonds to its owner. The present system encompasses a subscription-based method for registering jewelry and diamonds, a novel micro-label for placement on a watch, a bracelet, ring, etc., and a method for recovering lost jewelry and diamonds that have been registered in accordance with the present invention.

Figure 1:
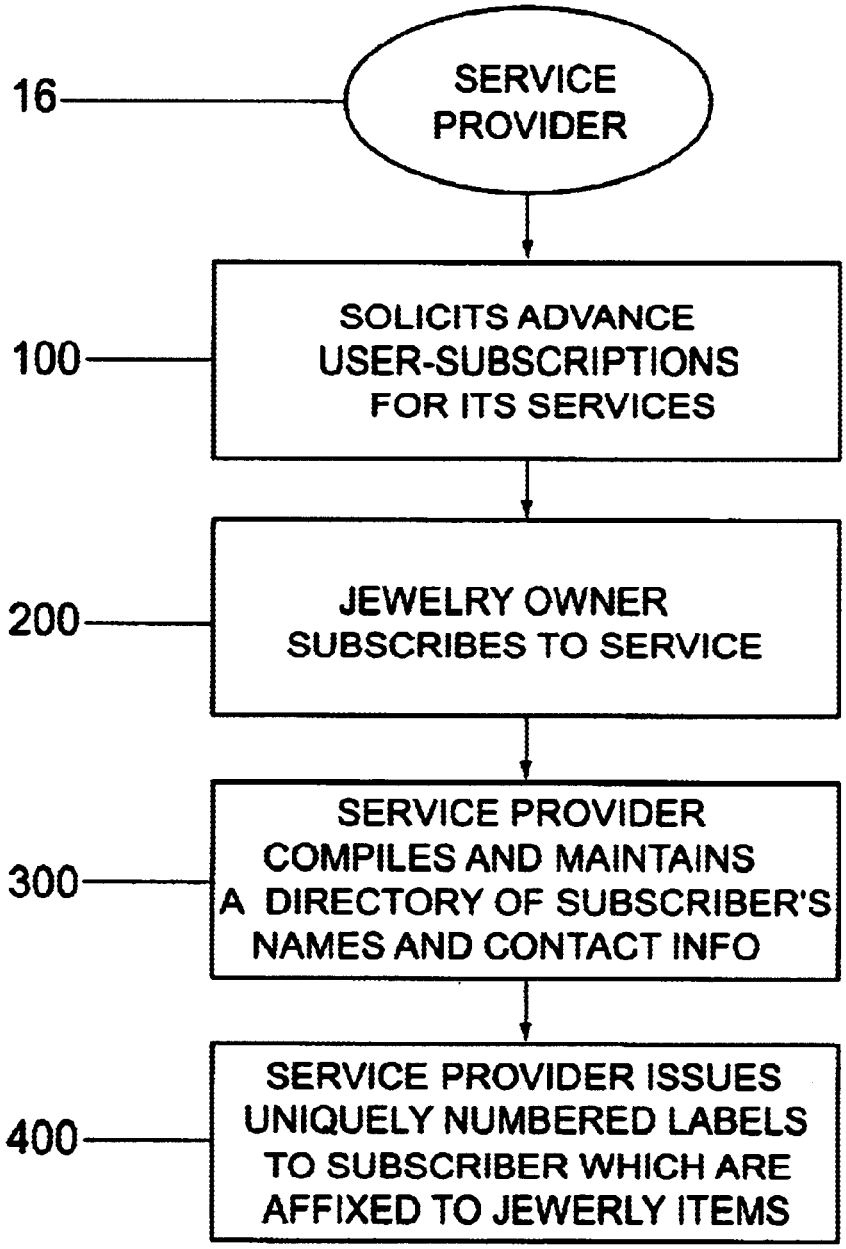
FIG. 1 is a flow diagram illustrating the subscription-based method for registering jewelry and diamonds according to the system of the present invention.

In practice, as shown in FIG. 1, a service provider 16 solicits advance user-subscriptions for its services at Step 100. At Step 200, the jewelry owner subscribes to the service and at Step 300, the service provider compiles and maintains a directory of its subscribers' names and telephone numbers. At Step 400, the service provider issues a series of micro-labels 2 to the subscriber each bearing a unique alpha-numeric code 6 assigned to that subscriber, and each bearing the message "1-866-RETURN ME" or another alphanumeric telephone number designed as a prompt to call the number. The subscriber is encouraged to mark his or her jewelry items with their unique subscriber code 6, and has the option of affixing the coded micro-labels 2 to each of his or her jewelry items. Alternatively, the subscriber may have the jewelry items micro-engraved with the unique code and toll-free telephone number. For example, in the case of diamonds, the subscriber has the girdle of the diamond laser inscribed with the unique code and toll-free telephone number.

Figure 2:
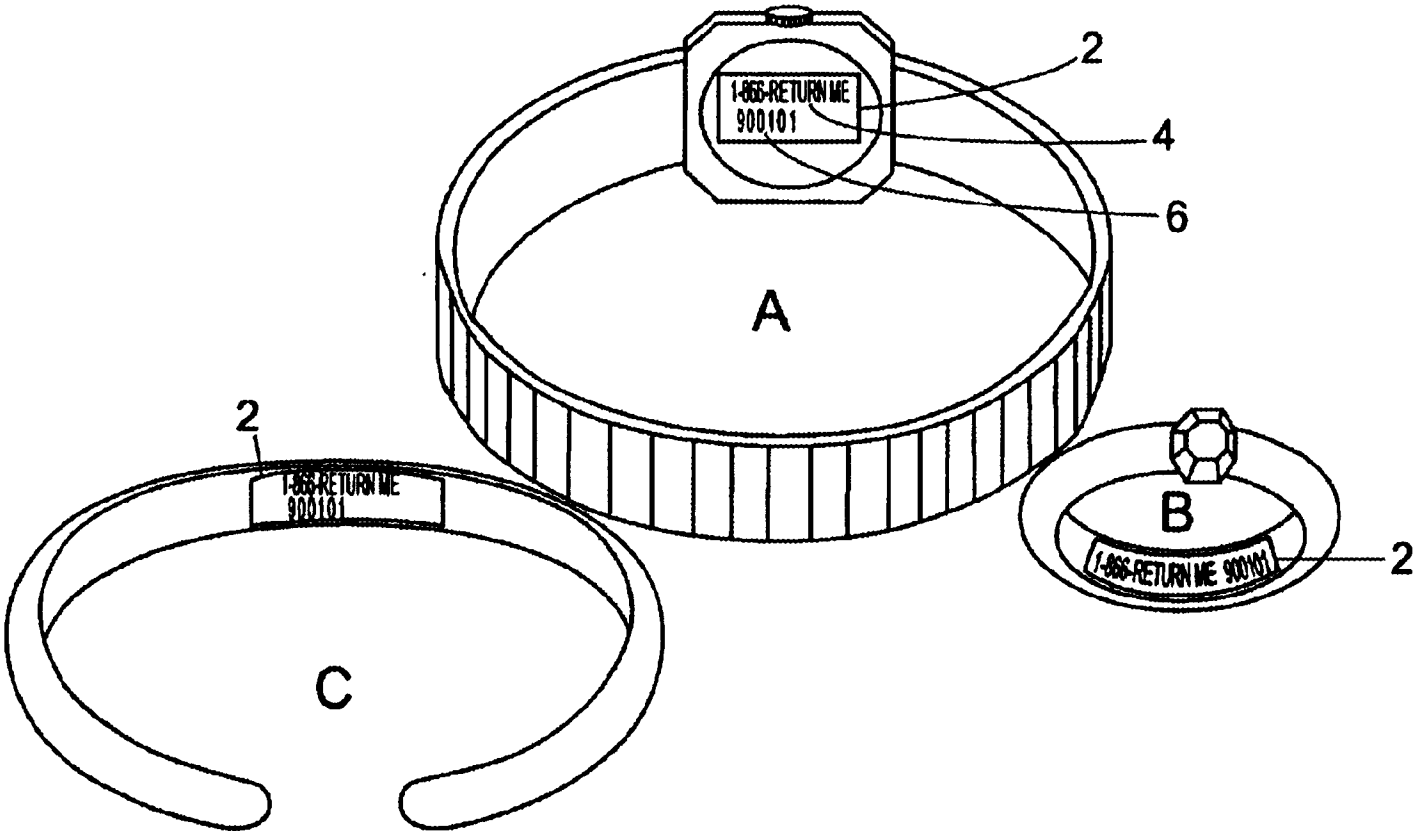
FIG. 2 is a view of a micro-label and its exemplary placement on a watch, a bracelet, and a ring.

As shown in FIG. 2, a micro-label 2 is affixed to a piece of jewelry. The label according to the present invention is a thin polyester film with a solvent resistant top-coat and an acrylic pressure sensitive adhesive. In a preferred embodiment, the label has a thickness of 0.0020 inches (0.051 mm). The micro-label can withstand elevated temperatures of over 260 degrees Fahrenheit for prolonged periods of time, and has a good resistance to solvents, alcohol, salt, oil, water, detergents, and degreasers.

The micro-label is discreetly placed on the underside of the jewelry in such a manner that it is not visible when worn. As shown in FIG. 2, the micro-label 2 is adaptable for use on a variety of jewelry including a watch 2A, a ring 2B, and a bracelet 2C.

The micro-label bears the message "1-866-RETURN ME" or a similar toll free phone number 4 comprised of words which would prompt a finder to call the number. Beneath or beside the phone number is an alpha-numeric code 6 assigned to the owner of the jewelry at the time the owner subscribes to the recovery service. The phone number and the alpha-numeric codes are imprinted in black on the white labels for optimal contrast and hence visibility. In a preferred embodiment, the characters have a height of 0.310 inches (0.787 mm). The printing is highly resistant to wear caused by rubbing or scratching. Alternatively, the toll free number and alpha-numeric code are micro-engraved (such as by laser-inscription) directly onto the piece of jewelry as shown in FIG. 3.

Figure 3:
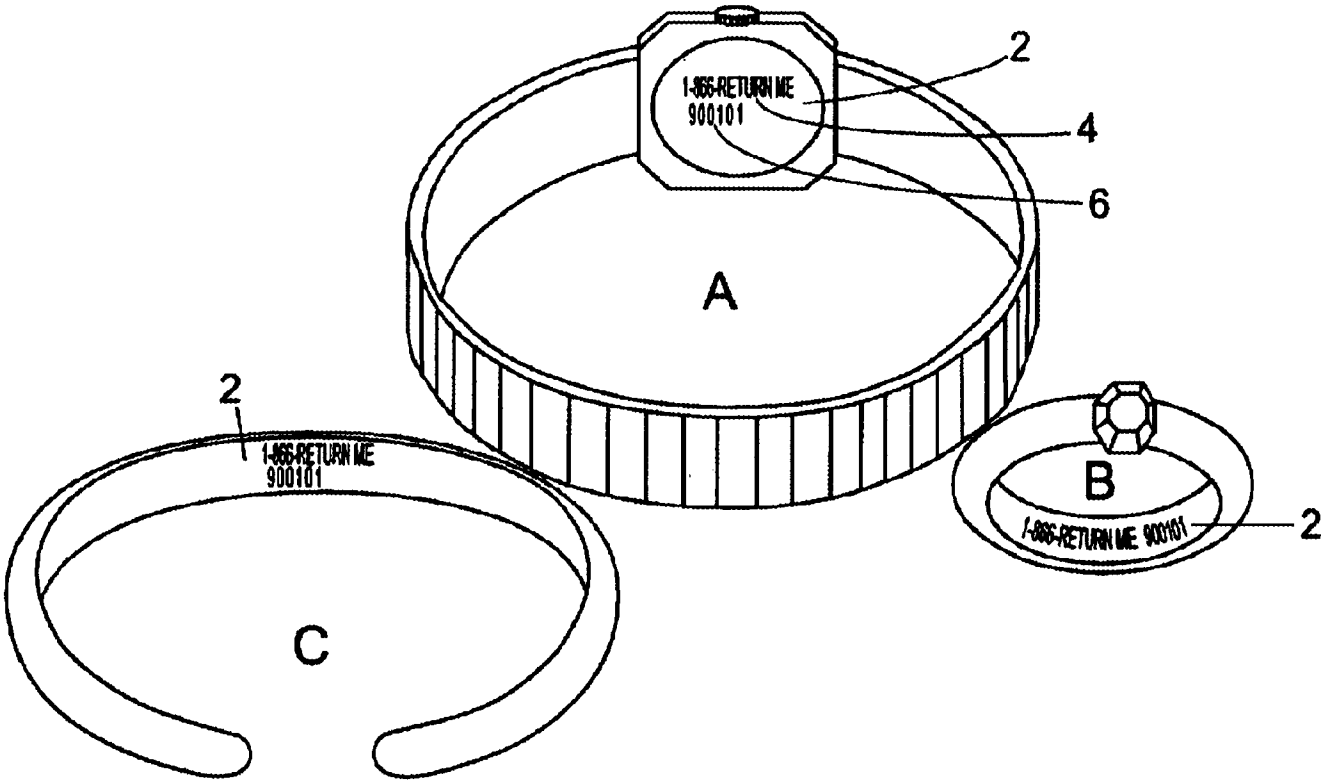
FIG. 3 is a view of exemplary micro-engraving placement on a watch, a bracelet, and a ring.

As shown in FIG. 3, a piece of jewelry is micro-engraved 102 with the same message as the micro-label of FIG. 2, i.e, the toll free phone number 104 and owner's unique alpha-numeric code 106. The micro-engraving is discreetly placed on the underside of the jewelry in such a manner that it is not visible when worn. As shown in FIG. 3, the micro-engraving 102 is adaptable for use on a variety of jewelry including a watch 3A, a ring 3B, and a bracelet 3C.

Engraving is preferred for jewelry which is worn often, such as a wedding band, because the micro-label may become detached as the result of frequent use. Additionally, diamonds may also be labeled directly by laser inscription on the girdle (or flat surface) of the diamond, as shown in FIG. 4.

Figure 4:
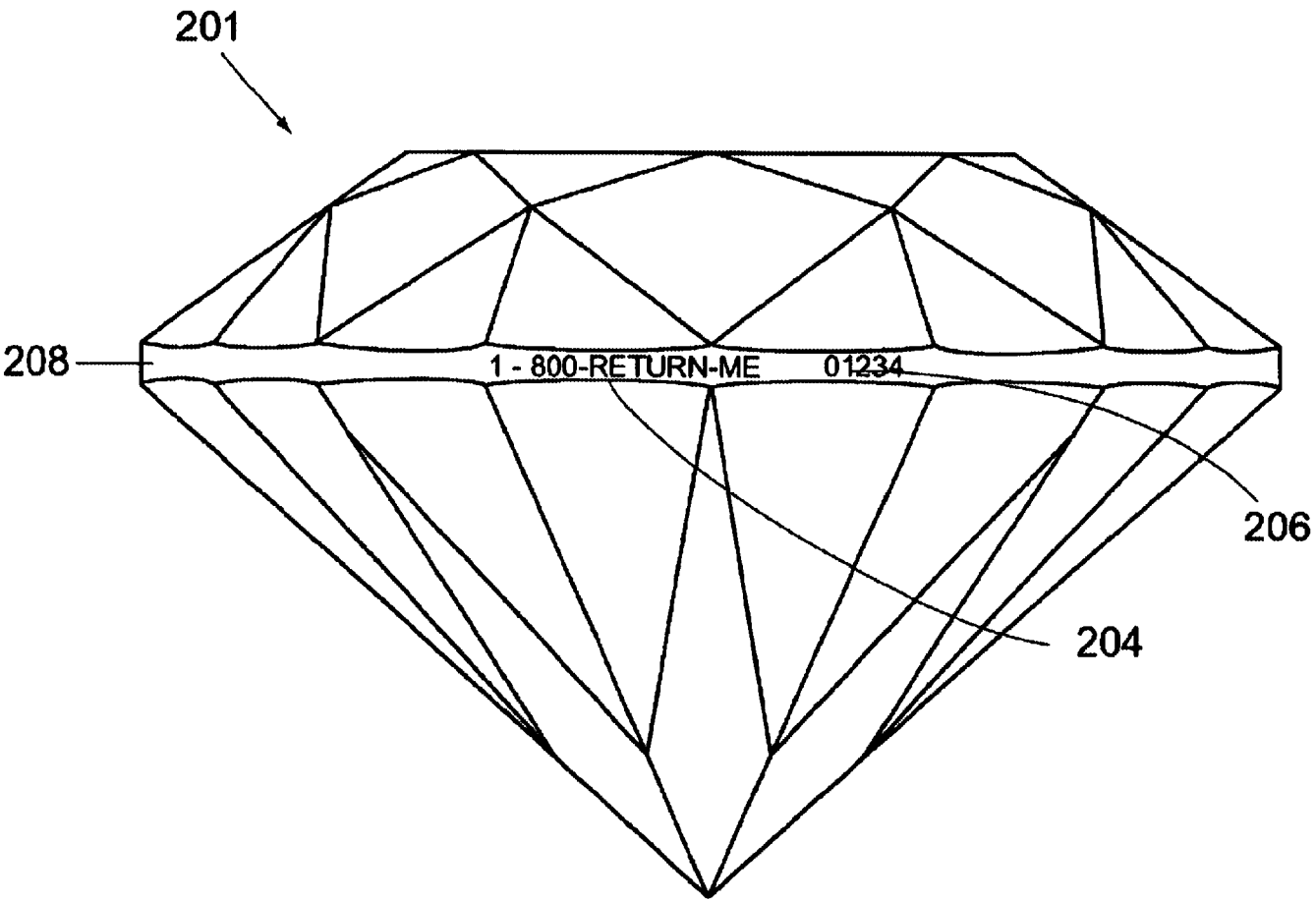
FIG. 4 is a view of exemplary laser-inscription placement on a diamond.

The diamond 201 of FIG. 4 is laser inscribed 202 with the same message as FIG. 2 and FIG. 3, i.e., the toll free phone number 204 and owner's unique alpha-numeric code 206. The laser inscription is placed on the flat surface between the top and bottom of the diamond, commonly referred to as the "girdle" 208.

Figure 5:
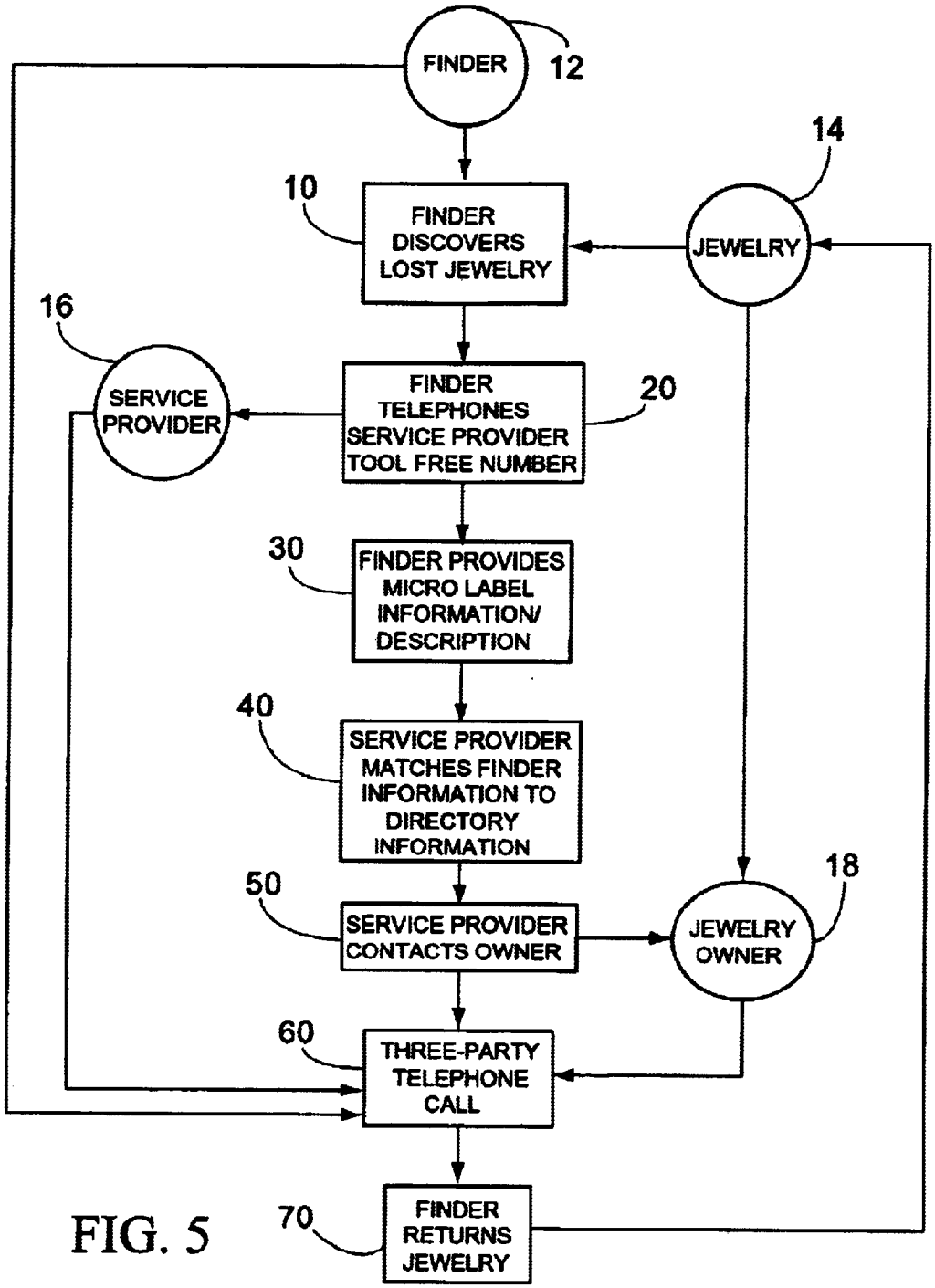
FIG. 5 is a flow diagram of the method for recovering lost jewelry and diamonds according to the system of the present invention.

The recovery process is shown in the flow diagram of FIG. 5. The service provider compiles and maintains a directory of its subscribers' names and telephone numbers cross-linked to the unique alpha-numeric code, as shown in Step 300 of FIG. 1. If the subscriber loses an article of jewelry 14 bearing one of said micro-labels or micro-engraved with the identification code or loses a laser inscribed diamond, his/her chances of recovery are vastly improved.

The recovery process begins at Step 10, when a finder 12 discovers a lost article of jewelry 14. Upon inspecting the lost article of jewelry 14, the finder 12 will notice the attached micro-label 2 or the micro-engraving 102. Upon closer inspection of the micro-label 2 or engraving 102, the finder 12 will see the toll free number bearing the message "1-866-RETURN ME", or similar number designed as a prompt for the finder 12 to call the number. The finder is thereby prompted to dial the toll free number which connects the finder 12 to service provider 16 at Step 20.

At Step 30, the finder 12 locates and relates the alpha-numeric code printed on the micro-label, or in the micro-engraving, and to provide a description of the item of jewelry found to the service provider.

At Step 40, the service provider 16 refers to said directory, and determines the identity of the owner 18. The service provider 16 contacts the owner 18 by telephone at Step 50, and verifies that the owner has lost the item of jewelry described by the finder.

If, at Step 50, the service provider confirms that the subscriber is the owner of the jewelry found by the finder, at Step 60, the service provider establishes a three-party teleconference 19 between the finder and the owner. During the teleconference the service provider 16 offers guidance to the parties with respect to the manner of return and suggests an appropriate reward. Further, the service provider offers a free lifetime membership to the finder in the jewelry lost and found service. Alternatively, the service provider calls the finder individually and instructs the finder to return the article of jewelry in the manner requested by the owner. At Step 70, the finder returns the recovered jewelry to the owner/subscriber.

The System used as described herein facilitates the recovery of lost or stolen articles of jewelry. A jewelry owner who subscribes to the service is thereafter better protected against permanently losing an article of jewelry. The method will find favor with public and private entities, such as police departments and lost and found departments, which must address the difficulties of establishing ownership of recovered articles of jewelry. Further, the System disclosed herein will find favor with insurers as their insured individuals will be better protected against losses for which claims would otherwise be made.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims:

I claim:

1. A method for recovering lost articles of jewelry, comprising:

compiling a database of names, addresses and phone numbers of jewelry owners who subscribe to the jewelry recovery service, and maintaining said database for access by a service provider;

assigning a series of unique alpha-numeric codes to each subscriber, each code corresponding to said subscriber, and maintaining the codes in the database to allow said service provider to cross-reference each code to its corresponding subscriber without knowledge of what jewelry said subscriber owns;

micro-engraving print including a toll free phone number and said unique alpha-numeric code to one of said articles of jewelry, said micro-engraved print conveying a prompt to a finder of the lost article of jewelry to call said phone number and report said code;

providing a live operator at said service provider to answer calls from each finder of lost articles of jewelry who call said phone number, said live operator thereupon receiving the alpha-numeric code from the finder and querying said database with the alpha-numeric code to determine the jewelry owner;

providing a representative of said service provider to contact the jewelry owner of said lost article of jewelry and to mediate transfer of said lost article of jewelry from the finder to the owner.

2. The method for recovering lost articles of jewelry according to claim 1, wherein said step of micro-engraving print further comprises micro-engraving said print discreetly on the underside of said jewelry in such a manner that it is not visible when worn.

3. The method for recovering lost articles of jewelry according to claim 1, wherein said micro-engraved print comprises a message including an alphanumeric telephone number comprised of words which would prompt a finder to call the number, and said unique alpha-numeric subscriber code.

4. The method for recovering lost articles of jewelry according to claim 1, wherein said step of providing a representative of said service provider to contact the jewelry owner of said lost article further comprises establishing a three-party teleconference between the finder, the owner, and the representative, whereby the representative offers guidance on the manner of return and an appropriate reward.

5. The method for recovering lost articles of jewelry according to claim 1, further comprising the step of offering a free subscription to the jewelry recovery service to each finder who returns lost jewelry registered thereby.

* * * * *